US007929726B1

(12) United States Patent
Jones

(10) Patent No.: US 7,929,726 B1
(45) Date of Patent: Apr. 19, 2011

(54) PLANAR DIAPHRAGM ACOUSTIC LOUDSPEAKER

(76) Inventor: Philip K. G. Jones, Chesterfield, MO (US)

( * ) Notice: Subject to any disclaimer, the term of this patent is extended or adjusted under 35 U.S.C. 154(b) by 1147 days.

(21) Appl. No.: 11/646,229

(22) Filed: Dec. 27, 2006

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 1/02* | (2006.01) |
| *H04R 1/20* | (2006.01) |

(52) U.S. Cl. ..... 381/431; 381/343; 381/399; 381/408; 381/421; 381/423

(58) Field of Classification Search ..... 381/343, 381/399, 408, 421, 423, 431
See application file for complete search history.

(56) References Cited

U.S. PATENT DOCUMENTS 4,276,452 A * 6/1981 Suyama et al. ..... 381/421
7,020,301 B2 * 3/2006 Koura et al. ..... 381/421

OTHER PUBLICATIONS

HiVi, Inc., S1 2-Way Ribbon Coaxial Mid-Tweeter datasheet found at http://www.swanspeaker.com/product/htm/view.asp?id=315 and dated May 25, 2007.
HiVi, Inc., RT1L Isodynamic Tweeter datasheet found at http://www.swanspeaker.com/product/htm/view.asp?id=226 and dated May 25, 2007.
Genesis Advanced Technologies Ribbon Tweeter technology profile found at http://www.genesisloudspeakers.com/ and dated May 25, 2007.

* cited by examiner

*Primary Examiner* — Curtis Kuntz
*Assistant Examiner* — Matthew Eason
(74) *Attorney, Agent, or Firm* — Kevin L. Klug

(57) ABSTRACT

A planar diaphragm acoustic loudspeaker having a planar diaphragm biased with a high magnetic flux density magnetic circuit which feeds an acoustic waveguide. The apparatus provides high fidelity and efficient acoustic reproduction of high frequency alternating current signals with a minimum of diaphragm resonance and with a substantially flat electrical input impedance versus frequency. The diaphragm has a substantially uniform drive across an acoustically active portion and is held in three dimensional space whereby any mass or diaphragm resonances are controlled and minimized. The acoustic waveguide mates with said diaphragm and ensures a uniform acoustic phase field and an optimal diaphragm acoustic impedance match with atmosphere.

20 Claims, 14 Drawing Sheets

PLANAR DIAPHRAGM ACOUSTIC LOUDSPEAKER

BACKGROUND OF THE INVENTION

The present invention relates in general to acoustic loudspeakers and more particularly, to a unique loudspeaker which utilizes a planar diaphragm which feeds a unique waveguide structure and is magnetically biased with one or more high flux density magnetic materials with a unique physical structure. The art of the present invention is especially useful for reproducing high frequency audio signals at high power levels with a minimum of distortion.

Traditional loudspeaker designs have utilized substantially tubular voice coils or solenoids peripherally attached with a diaphragm or dome which are driven with an alternating audio feed current and immersed (at least partially) within a magnetic field. That is, based upon established electromagnetic principles, the prior art attempts to direct and place a magnetic field perpendicular to voice coil current flow in order to create a force perpendicular to both the current flow and magnetic field direction. (that is according to Ampère, the vector force is equal to the vector cross product of the current and magnetic flux density, i.e. $\vec{F}=\vec{I}\times\vec{B}$) The resultant vectorial force is desirably focused in the direction of diaphragm movement.

This prior art technique relies upon a magnetic pole of a first polarity within the solenoidal structure and a second magnetic pole of opposite polarity surrounding the solenoid with the coils of the solenoid there between. Unfortunately during operation, some of the conductive coils of the prior art voice coils are either outside of the magnetic field bias or are carrying current in a non three dimensional orthogonal direction relative to the magnetic field lines and the direction of movement of the diaphragm. That is, the prior art by its very design relies upon a fringing of the fields between north and south poles of the magnetic structure which is never quite orthogonal across the coil as a whole. This effect results in an undesirably high stray or leakage inductance (typically near 200 micro-henries (μH)) and inefficiencies which inhibit or limit higher frequency audio output.

Also, when the prior art voice coil or solenoid excitation is utilized, the resultant forces exist near or at the periphery or edge of the diaphragm and not uniformly over the diaphragm. Since the diaphragm is typically of a thin, lightweight, high strength and stiffness, and somewhat flexible (preferably dielectric) material such as mylar, it is susceptible to dynamic deformations. (other materials include but are not limited to silk, aluminum, or titanium) As acoustic drive frequencies increase, the diaphragm itself may begin to flex or resonate at its natural frequency or harmonics thereof. That is, since the surface of the diaphragm is not driven directly, i.e. only the edges are driven, the surface of the diaphragm may deform or develop mode resonances to match the edge feed boundary conditions. Obviously, the diaphragm resonance frequencies and harmonics thereof are dependent upon a plurality of factors including but not limited to Young's modulus, density, thickness, etc. of the diaphragm material. Attempts at utilizing an acoustically lossy diaphragm material to dampen said resonances are marginally effective and have reduced acoustic output efficiency and power.

A peripheral diaphragm or dome coil drive also limits the ability of the loudspeaker to acoustically reproduce the drive signal. That is, since the voice coil substantially moves pursuant to the force imputed by the drive current, failure of the diaphragm or dome to fully track the voice coil movement results in a phase distortion or breakup in the acoustic output. Also, the voice coil itself adds undesirable mass which in conjunction with a spring like attachment of the diaphragm with the speaker housing or mount creates a lower frequency resonance.

The aforesaid effects are readily observed when the impedance (typically ordinate axis) of the loudspeaker is plotted versus frequency (typically abscissa axis) within the mechanical and magnetic hysteresis limits of the loudspeaker. That is the impedance seen across the terminals of the voice coil. At lower frequencies, the voice coil resistance is dominant with a free-space resonance (i.e. the aforesaid mass and spring effect) found as the drive frequency increases. Said resonance is primarily due to the diaphragm and solenoid mass interaction with the diaphragm elastic spring equivalence attachment and is usually below one or two kilohertz for an approximately 25 millimeter diameter domed diaphragm. Midrange frequencies generally exhibit a somewhat flat impedance versus frequency characteristic. That is, the reactive or $j\omega L$ (j is the 90 degree imaginary phase lag mapping operator, ω is the radian frequency, and L is the stray coil inductance) contribution is relatively small compared to the resistive (typically 3.5-8 ohms (Ω)) portion of the solenoid or voice coil. At higher frequencies, the prior art exhibits a primarily inductive reactive response with the complex impedance magnitude following somewhat linearly with frequency except for the aforesaid diaphragm resonance.

When designing loudspeakers for primarily higher frequency audio reproduction (i.e. tweeters) the lower and midrange effects are of less concern since the drive amplifier circuitry, typically a passive or active crossover network, is designed to drive the loudspeaker at higher frequencies. Although undesirable, even the increased and primarily inductive reactive impedance increase verse frequency may be compensated for with a properly designed differentiating amplifier feeding the loudspeaker. That is, the output impedance of the amplifier feed is substantially matched as the complex conjugate of the loudspeaker input impedance. Unfortunately the prior art diaphragm resonance is so unpredictably and non-linear that compensation is difficult on an individual component basis and highly impractical if a repeatable manufacturing process is desired.

Although the prior art diaphragm resonance is often at the limits of the audible range, an audible effect or product may be heard under the proper excitation circumstances. That is, sub-harmonics of the diaphragm resonance may excite the diaphragm resonance which may then combine with other drive frequencies within the non-linear diaphragm material and surrounding mediums to produce audible difference frequencies as inter-modulation distortion. This effect is further exacerbated due to the non-linear complex impedance of prior art voice coils. That is, due to a per cycle movement through regions of varying magnetic flux density, the voice coil inductive reactance changes during portions of each cycle which further introduces inter-modulation products and stimulates a diaphragm resonance. For high fidelity reproduction, this effect is unacceptable. It is also an unacceptable requirement for the speaker drive amplifier to overly compensate for leakage inductance or other anomalies of the speaker.

The present art utilizes a thin and substantially flat diaphragm of a preferably kapton or polyimide material with a planar coil electrical conductor which is etched or deposited (preferably of an aluminium material) thereon and suspended, over a high flux density magnetic field. During operation, the entire planar coil is immersed within the magnetic bias field which minimizes leakage inductance (typically 20 μH). That is, the planar coil current is substantially transferred into diaphragm movement which is seen primarily as a resistive load and not reactive. Also, utilization of a planar voice coil minimizes the prior art solenoid mass and thereby minimizes any lower frequency free-space resonances.

The magnetic field of the present art is further amplified with a neodymium magnetic (i.e. $Nd_2Fe_{14}B$ or equivalent with an approximate 1.38 Tesla remnant magnetic flux density or greater) disk placed nearest to the diaphragm within the diaphragm magnetic circuit bias. A uniquely layered strontium ferrite ($SrFe_{12}O_{19}$) magnet structure positioned below the topmost plane of the neodymium magnet provides an opposite magnetic bias to the neodymium, serves to bend the magnetic flux emanating from the neodymium magnet more orthogonal to diaphragm movement and current flow, and serves to complete the magnetic bias circuit. The present art further acoustically loads the center and periphery of the diaphragm with a high density urethane, felt, polymer, or rubber type material which minimizes diaphragm self resonance or harmonics thereof and the induced diaphragm stretching effect due to any magnetic flux emanation in the direction of diaphragm movement. The present art uniquely drives substantially all of the acoustically active portion of the diaphragm instead of simply the periphery.

The present art is distinguished from prior art ribbon or coaxial ribbon tweeters via utilization of a unique magnetic circuit along with the aforesaid components and an acoustic horn waveguide which maximally matches the acoustic impedance of free space with the diaphragm acoustic impedance and provides a uniform phase field off axis of the speaker central axis. The present art further minimizes the parasitic inductance by a factor of ten (typically 20 μH) relative to the prior art. Unlike the prior art ribbon type tweeters, the present art further presents a direct current (dc) resistive load of approximately 3.5Ω-4Ω which is desirable for conventional amplifier drives.

The fixed waveguide has a central phase plug which sandwiches the central portion of the diaphragm with the neodymium magnet with a layer of urethane, flexible rubber, polymer, or felt like material between each interface as appropriate. The waveguide is constructed of a lossless material and assures that acoustic energy emanating from any circumferential diaphragm position does not travel out of phase to any three dimensional point within the far acoustic field, thereby inhibiting phase distortion. The waveguide sandwich further minimizes the possibility of diaphragm resonance within the audible spectrum. Since the center of the diaphragm is held, any resonance modes must be of a higher order and thereby of a higher frequency for an equivalent diaphragm diameter. As the diaphragm resonance is pushed substantially beyond human perception, even sub-harmonic excitation and intermodulation products produced therefrom are imperceptible.

Accordingly, it is an object of the present invention to provide a planar diaphragm acoustic loudspeaker which minimizes leakage or parasitic inductance, maximizes efficiency, and substantially eliminates acoustically perceptible diaphragm self resonance.

Another object of the present invention is to provide a planar diaphragm acoustic loudspeaker having a uniquely positioned waveguide structure which provides a substantially uniform phase field and minimizes phase distortion off axis.

A further object of the present invention is to provide a planar diaphragm acoustic loudspeaker having a unique magnetic bias structure which maximizes magnetic flux density at a planar coil while positioning said flux maximally orthogonal to diaphragm movement and current flow.

A still further object of the present invention is to provide a planar diaphragm acoustic loudspeaker which substantially flattens the input impedance versus frequency relative to the prior art.

A still further object of the present invention is to provide a planar diaphragm acoustic loudspeaker which minimizes free-space or self resonance.

SUMMARY OF THE INVENTION

To accomplish the foregoing and other objects of this invention there is provided a planar diaphragm acoustic loudspeaker having a substantially planar diaphragm with a planar conductive coil placed within a magnetic bias circuit which feeds an acoustic impedance matching waveguide structure. The present art with its unique combination of elements is especially useful in high frequency audio tweeter type loudspeaker applications.

In the preferred form, the loudspeaker comprises a housing or can of a ferromagnetic material such as a low carbon and silicon steel which mates with an acoustic horn waveguide, between which the remaining speaker components are placed and retained. The horn waveguide is preferably attached with said housing via peripheral screws or fasteners positioned through ears in said housing. In addition to its structural function, the housing serves to complete the magnetic bias circuit.

Within said housing is first placed a bucking magnet ring, preferably of a strontium ferrite material, with a T-yoke of a low carbon, low silicone steel placed there over. The T-yoke is of preferably disk shape and has a central protrusion around which a primary biasing magnet ring, also preferably of a strontium ferrite material, is placed and seats upon said disk. The primary biasing magnet ring seats onto said disk with a like magnetic polarity interface with the bucking magnet. That is, as placed within said housing, absent the totality of other assembly factors and features, the primary biasing magnet and bucking magnet would have a repelling force there between.

Onto the T-yoke central protrusion is placed a high flux density (i.e. high residual magnetic induction) magnetic disk, preferably of a neodymium-iron-boron alloy, and onto the primary biasing magnet a substantially planar ring, also of a low carbon, low silicon steel material. The planar ring has an outside diameter approximately equivalent to the inside diameter of the housing and an inside diameter slightly smaller than the inside diameter of the primary biasing magnet yet slightly larger than the diameter of the T-yoke protrusion. The planar ring is preferably placed in substantially the same plane as the magnetic disk.

The planar diaphragm and coil in combination with the associated mounting portions or carrier is preferably centrally placed over said planar ring and magnetic disk combination and magnetically biased therefrom. A first absorber disc of a small felt or equivalent material is positioned centrally between said diaphragm and said magnetic disk and a second absorber disk of a urethane or rubber like material of substantially equivalent size is placed centrally between the diaphragm and the waveguide. When attached with said housing, the waveguide preferably compressively holds and positions the carrier which holds said diaphragm with said ring and disk via a recess within a backside of said waveguide. If a protective screen is utilized between the waveguide and the diaphragm, a third absorber disk of preferably urethane or equivalent material is placed between the screen and the second disk.

The planar coil comprises a spiral of a preferably conductive aluminum material etched or printed upon the diaphragm, preferably of a polyimide such as kapton, on the acoustically active portion(s) of the diaphragm which is exposed to ambient atmosphere through said waveguide. The diaphragm and coil are held within the non conductive carrier with electrical contacts extending therefrom external to the housing. That is, the spiral begins near the periphery of the diaphragm and extends toward the center of the diaphragm yet ends prior to reaching the diaphragm center. Spiral electrical connection is made between the periphery of the coil and the diaphragm center.

Acoustic emanations from the center portion of the diaphragm are substantially blocked by the combination of the waveguide central phase plug and the dampening effect of the afore described central absorber disks. With the diaphragm center and periphery substantially held, any diaphragm resonances must occur at higher than primary modes which are generally outside of the audible spectrum. The waveguide phase plug further assures that a uniform phase field is heard off axis of the loudspeaker by blocking emanations from one side of the diaphragm which transmit to and with opposite side emanations in far field three dimensional space. In a preferred form, the phase plug is held by three arms and comprises an approximate conical ogive form of greater diameter nearest the diaphragm (proximally) and smallest diameter (i.e. pointed and distally) away from the diaphragm which serves to impedance match the diaphragm to atmosphere.

As described, the magnetic permeability of the planar ring steel is generally less than that of the strontium ferrite primary biasing magnet ring. With the primary biasing magnet ring top surface below the diaphragm surface by at least the thickness of the planar ring, the magnetic flux emanating from the magnetic disk is allowed to bend more profusely in the non-magnetic or fringing space occupied by the diaphragm than if the planar ring was of a higher permeability. This phenomena assures a more desirable orthogonal relationship between current flow, magnetic flux, and diaphragm movement.

The aforesaid apparatus in combination uniquely provides a high frequency audio output which substantially mirrors the current drive input with a minimum of distortion there between. The electrical input reactance is approximately one tenth (i.e. 20 μH) of the prior art voice coil configurations. The typical low frequency resonance of prior art loudspeakers is substantially reduced while the audible high frequency diaphragm resonance is substantially reduced. With the present art, theoretical diaphragm resonances and inter-modulation distortion products thereof are substantially reduced or eliminated or occur substantially outside of the audible spectrum.

The art of the present apparatus may utilize a conventional amplifier drive to provide a high fidelity acoustic reproduction of the drive signal without the sophisticated or specialty compensation circuitry required with the prior art. Furthermore, due to increased efficiency, the drive power required for a specific audio output is reduced.

The aforesaid components may be manufactured from a plurality of materials. The magnetic disk is preferably manufactured from a material having a large magnetic residual induction, including but not limited to neodymium-iron-boron, alnico, or other materials. The bucking and primary biasing magnet rings are preferably manufactured from a high magnetic permeability material with a high electrical resistance which exhibits a low eddy current loss and further has a reasonably high residual induction, including but not limited to strontium or barium ferrites or other materials. The T-yoke, planar ring, and housing may be formed from any ferromagnetic material having a magnetic flux density saturation greater than the magnetic flux induced within by the combined residual induction of the previously specified materials, including but not limited to low carbon and low silicon steel, iron, or other materials. The central disks between the waveguide, diaphragm, and magnetic disk may be of a urethane, felt, rubber, or other material and are preferably acoustically lossy but may be of a substantially lossless material. The acoustic horn waveguide is preferably manufactured from a low acoustic loss material including but not limited to high density polymers, metals, ceramics, or other materials.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
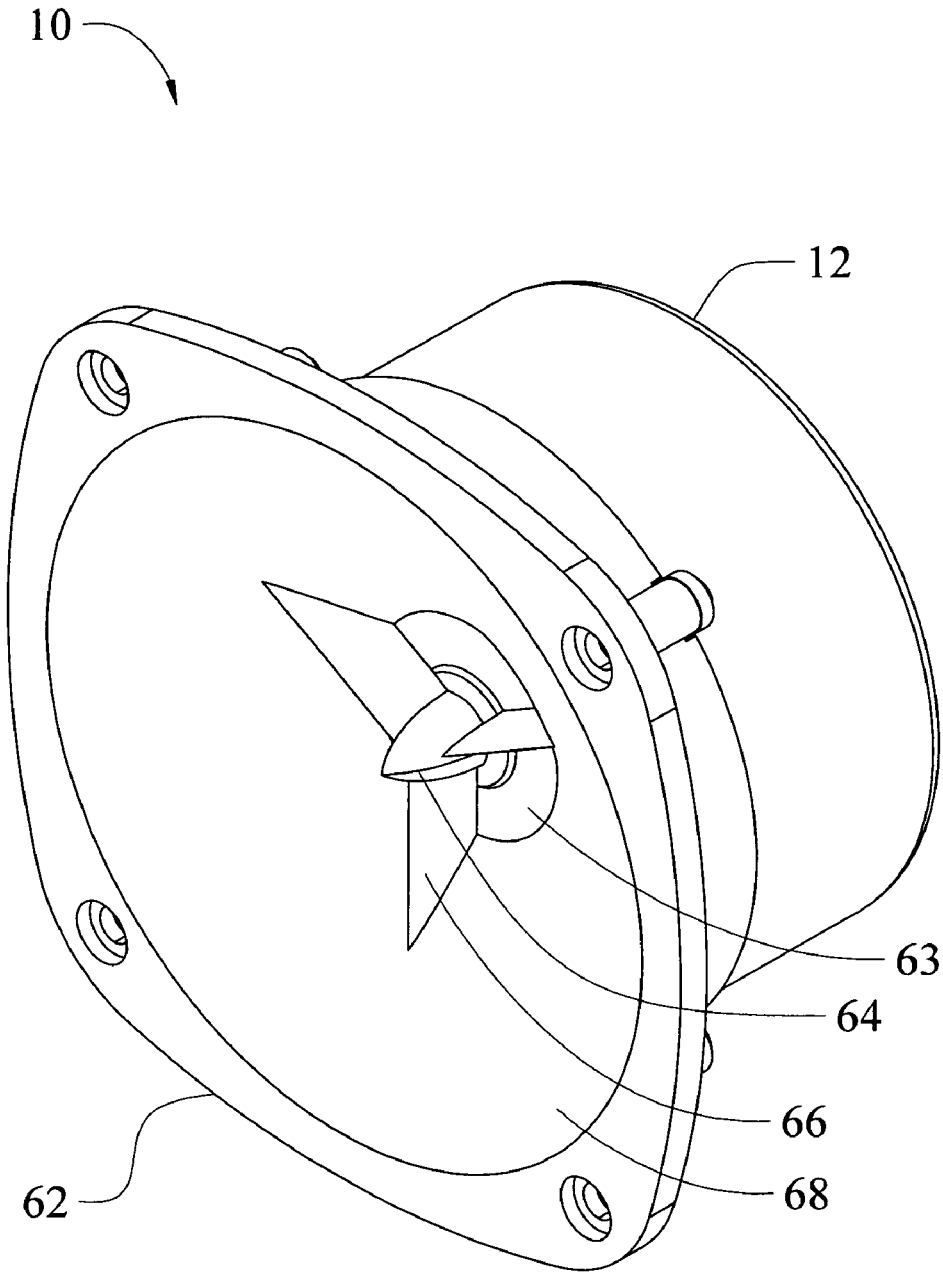
FIG. 1 shows a perspective view of the planar diaphragm acoustic loudspeaker in assembled form.
Figure 2:
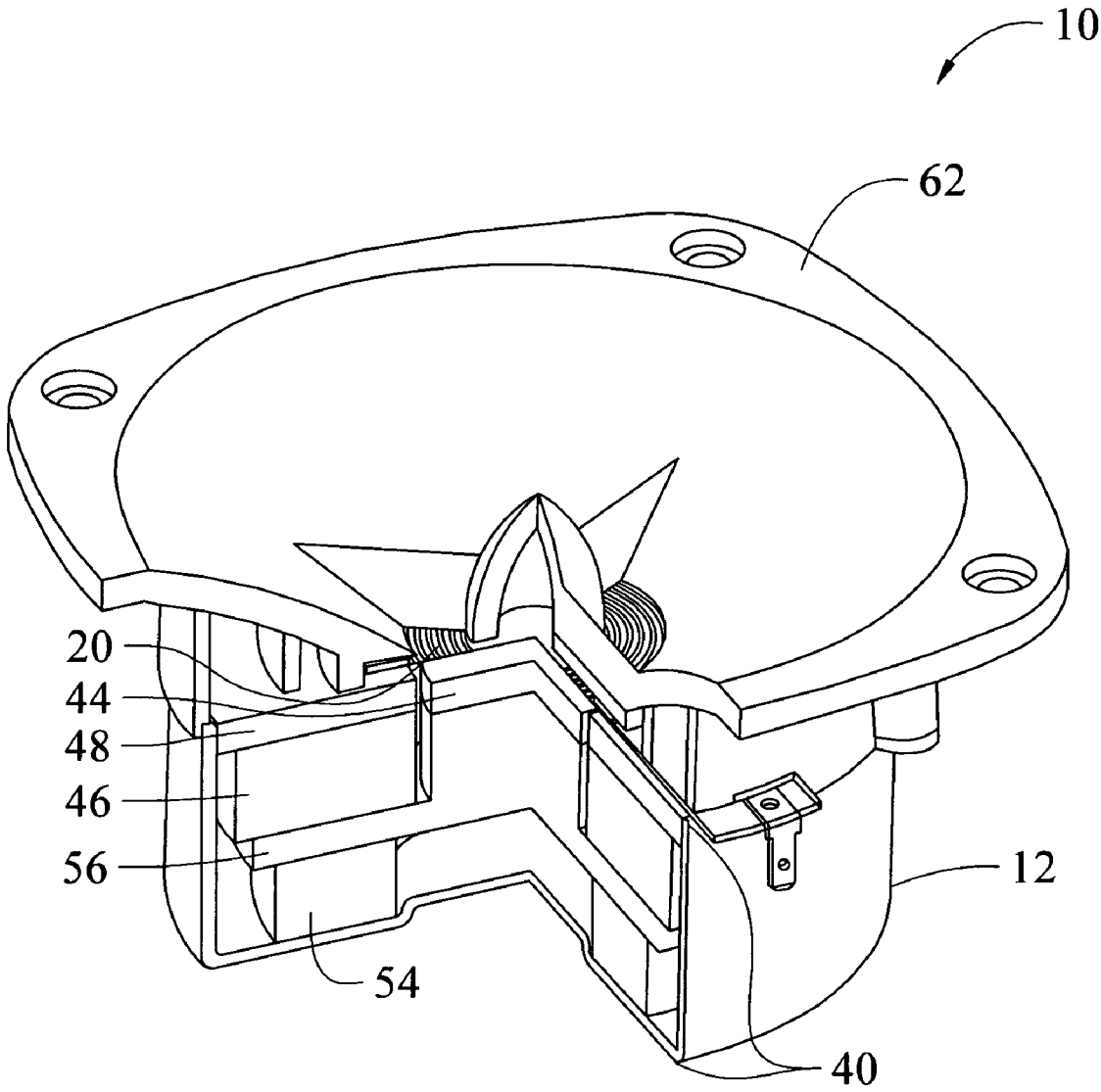
FIG. 2 shows a perspective view of the planar diaphragm acoustic loudspeaker in assembled form with a vertical quarter corner section removed further showing the internal assembly.
Figure 3:
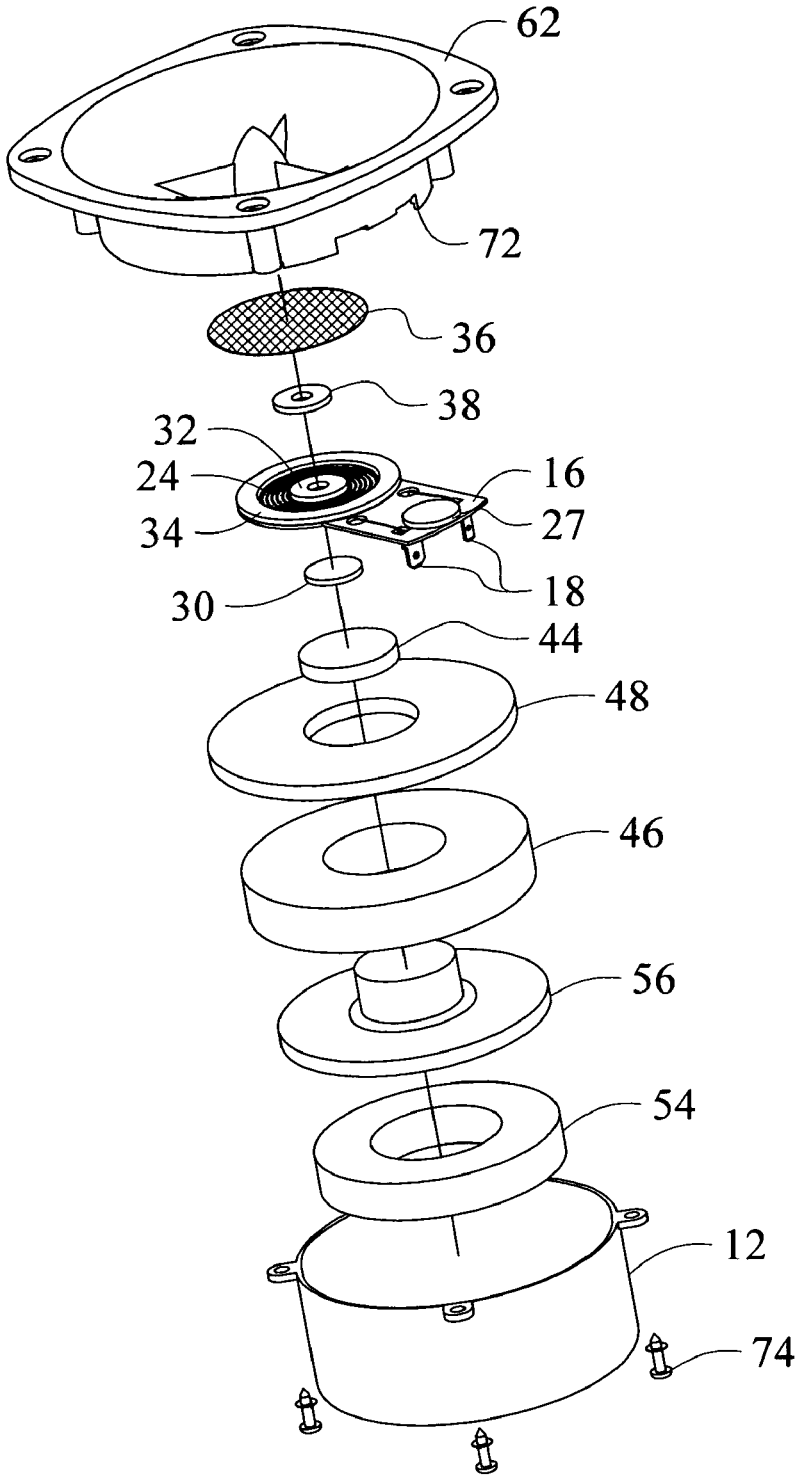
FIG. 3 shows an assembly view of the planar diaphragm acoustic loudspeaker.
Figure 4:
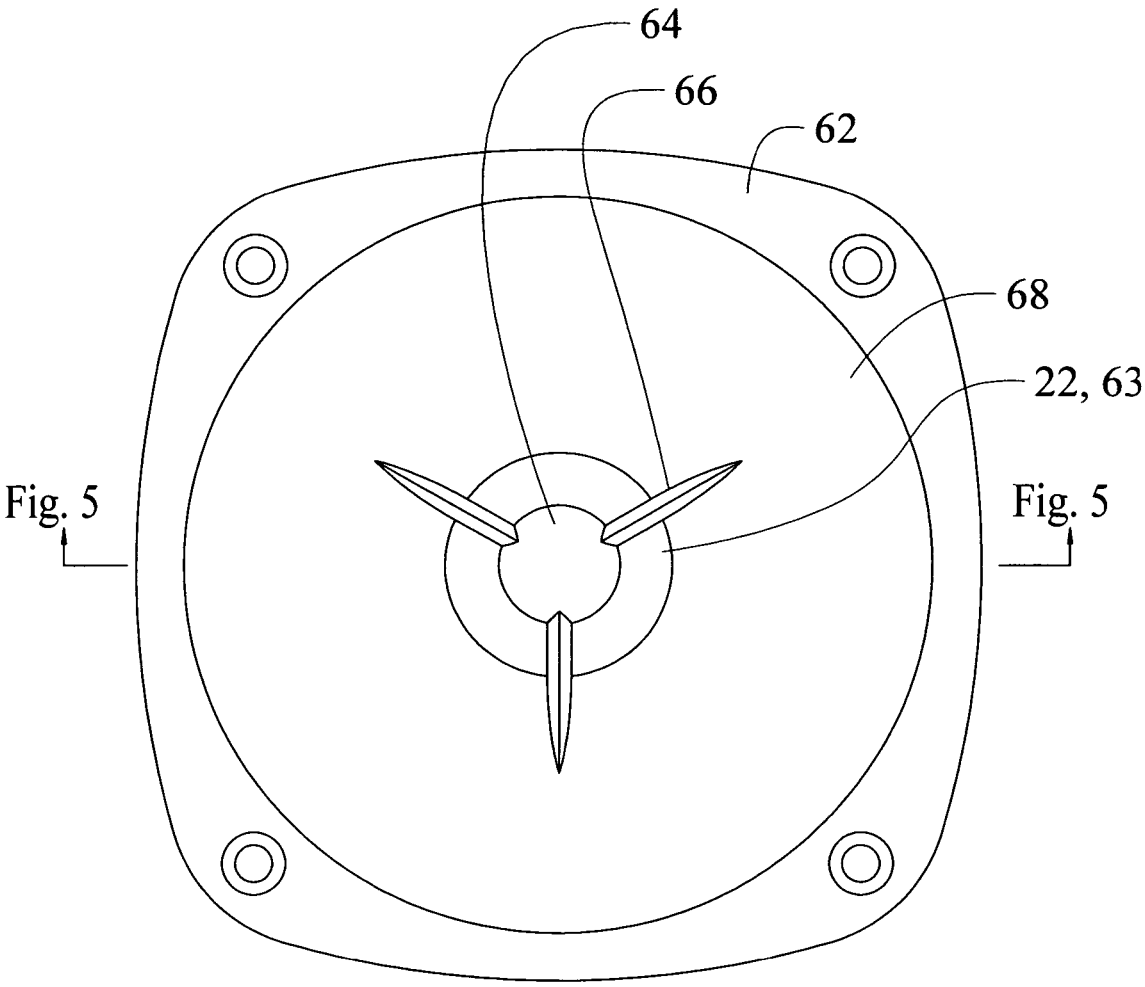
FIG. 4 shows a front plan view of the planar diaphragm acoustic loudspeaker.
Figure 5:
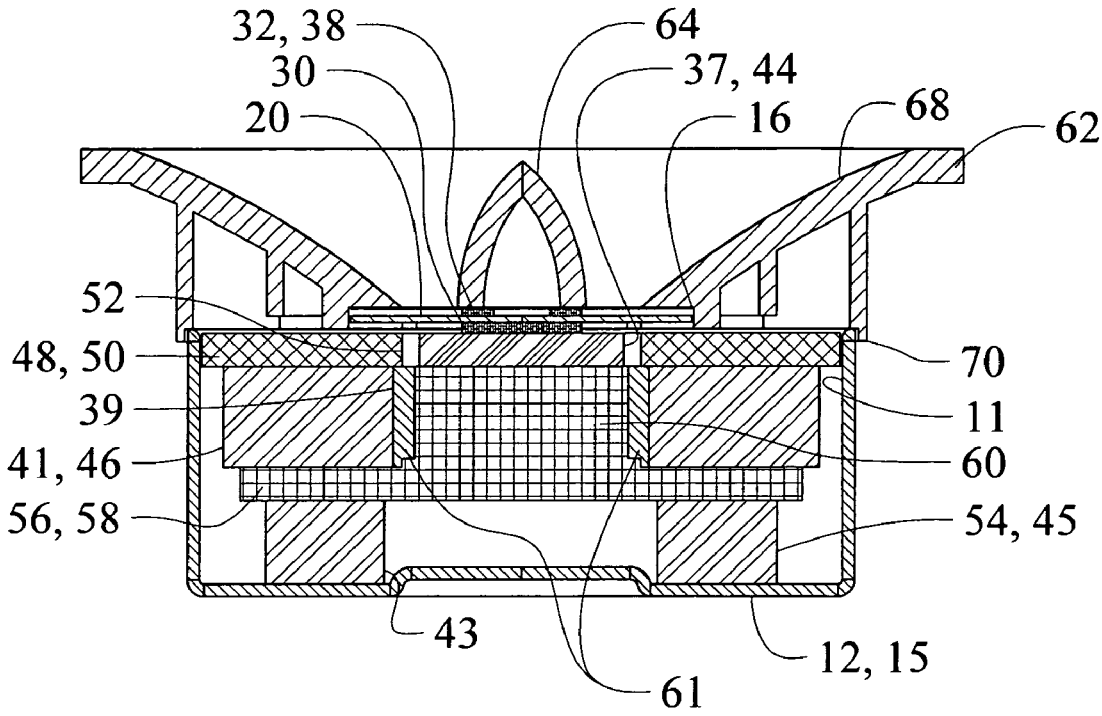
FIG. 5 shows a cross sectional view taken along lines 5-5 of FIG. 4.
Figure 6:
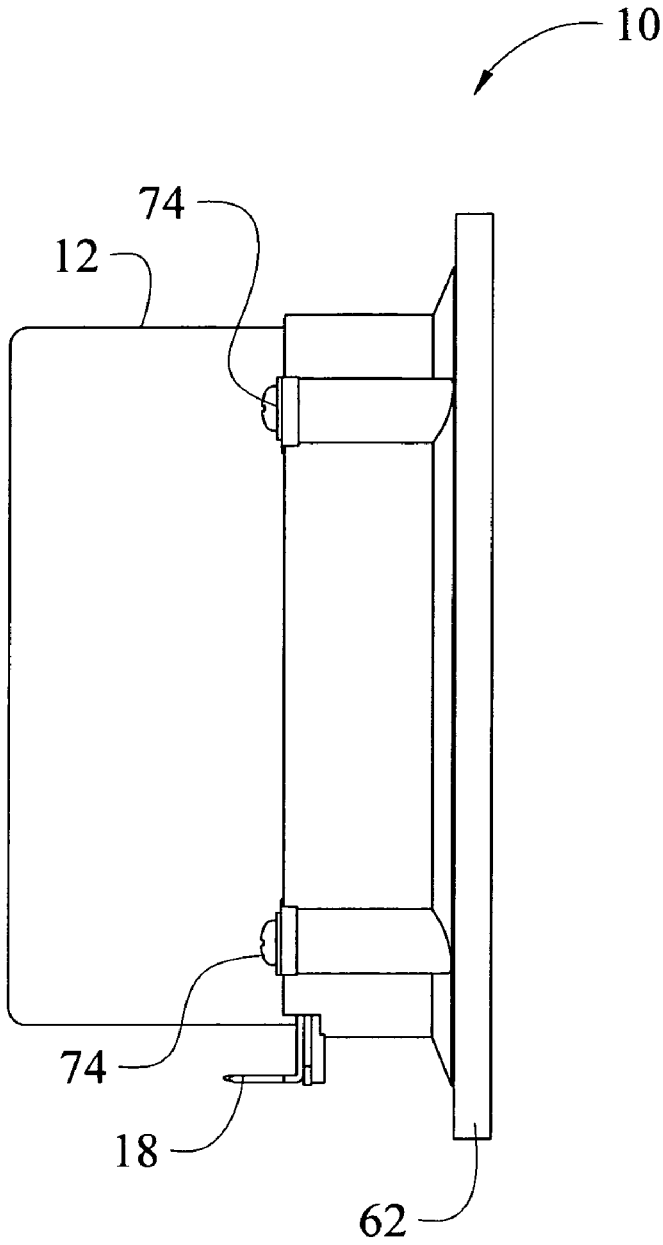
FIG. 6 shows a left side plan view of the planar diaphragm acoustic loudspeaker, the right side plan view being substantially a mirror image thereof.
Figure 7:
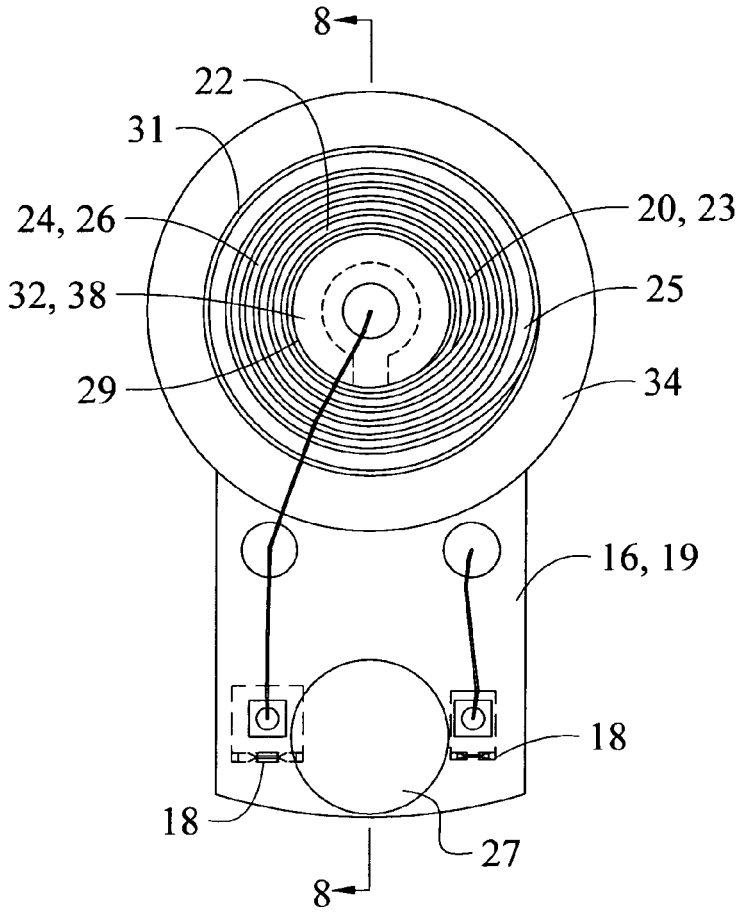
FIG. 7 shows a top side plan view of the carrier with the planar voice coil assembly.
Figure 8:
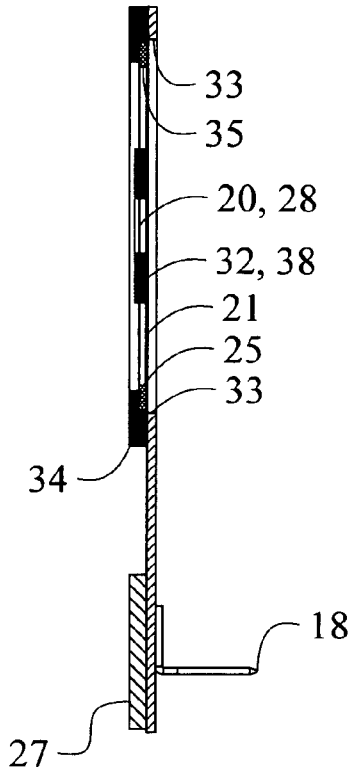
FIG. 8 shows a cross sectional view of the carrier with the planar voice coil assembly along line 8-8 of FIG. 7.
Figure 9:
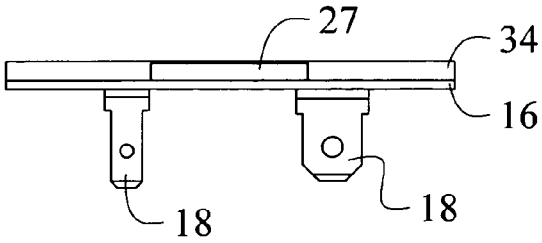
FIG. 9 shows a front side plan view of the carrier with the planar voice coil assembly.
Figure 10:
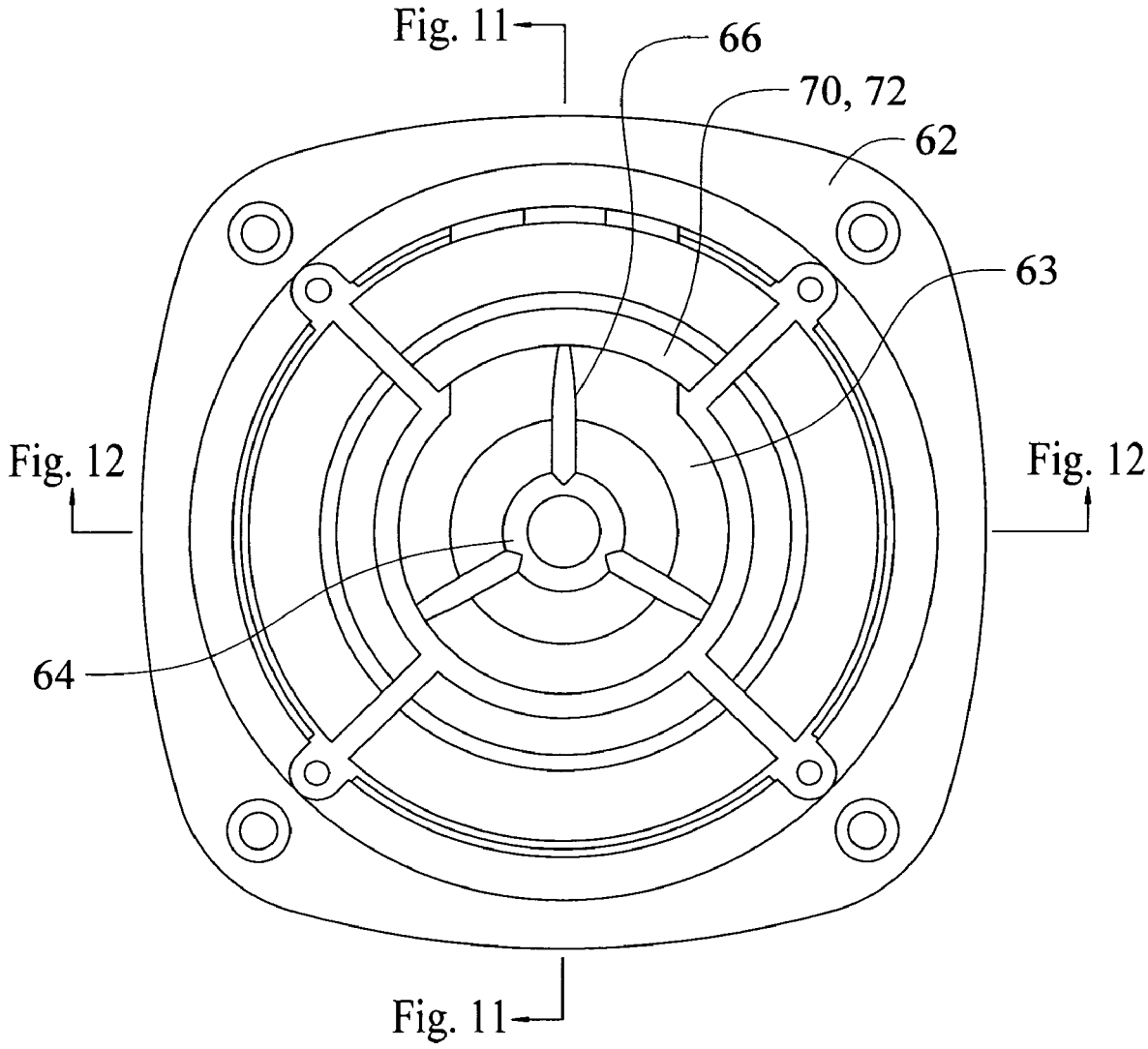
FIG. 10 shows a back side plan view of the acoustic waveguide.
Figure 11:
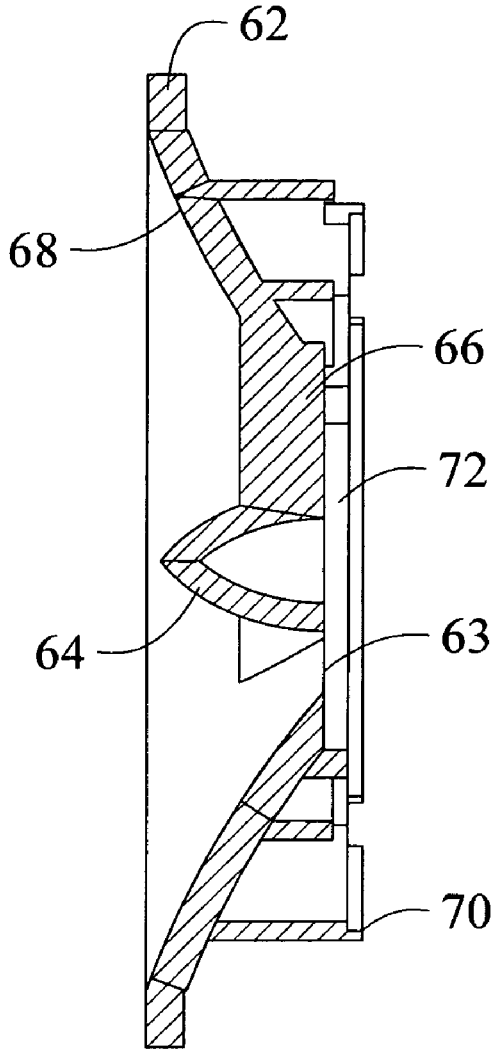
FIG. 11 shows a cross sectional view taken along lines 11-11 of FIG. 10.
Figure 12:
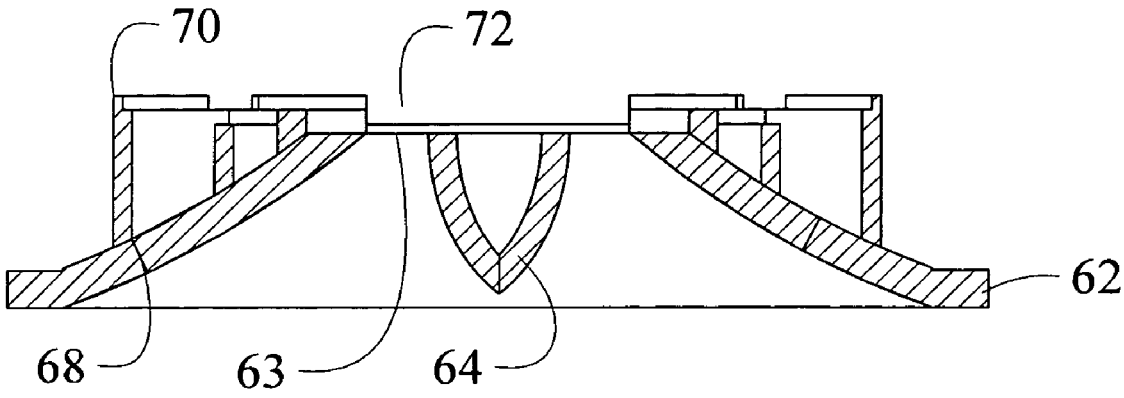
FIG. 12 shows a cross sectional view taken along lines 12-12 of FIG. 10.
Figure 13:
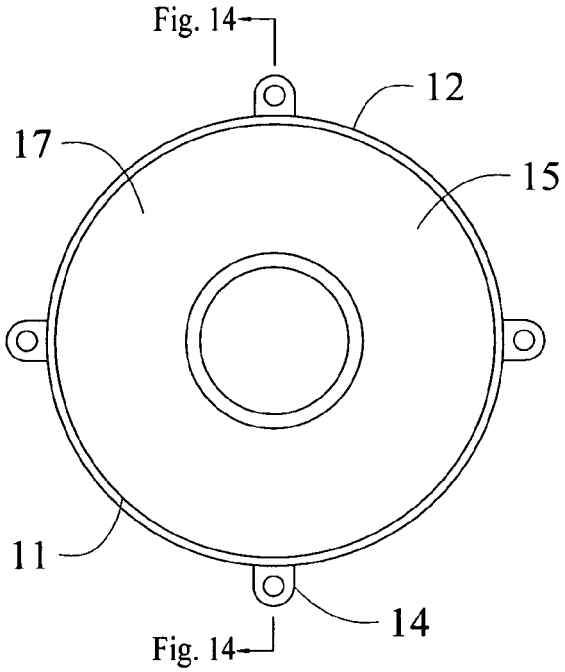
FIG. 13 shows a top plan view of the housing or can.
Figure 14:
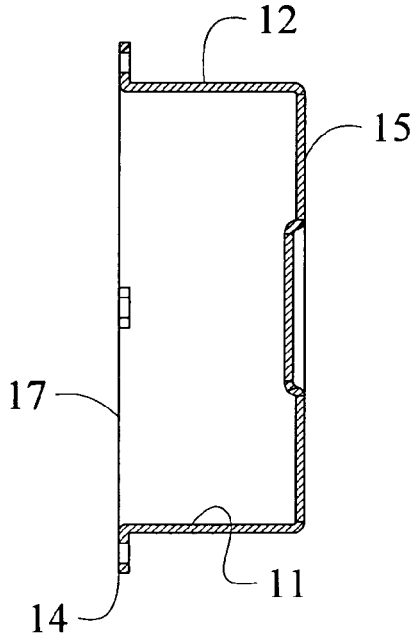
FIG. 14 shows a cross sectional view taken along lines 14-14 of FIG. 13.

Referring now to the drawings, the planar diaphragm acoustic loudspeaker 10 is shown in its preferred embodiment in FIGS. 1-17. The apparatus 10 is especially useful for high fidelity reproduction of high frequency acoustic signals with minimal distortion due to diaphragm or mass resonance and provides a reasonably flat acoustic output power versus frequency input over the frequency of operation.

In base form the planar diaphragm acoustic loudspeaker 10 comprises a housing 12 and an acoustic horn waveguide 62 between which is placed and held a magnetic bias circuit 40 and a carrier 16 which holds the planar diaphragm 20. Preferably the waveguide 62 attachment with the housing 12 is via ears 14 extending from said housing 12 through which screws or other fasteners 74 are placed into or through said waveguide 62. Said diaphragm 20 is placed and held within said magnetic bias circuit 40 and fed with an audio feed current whereby movement is induced onto said diaphragm 20 substantially orthogonally to the feed current and magnetic field bias directions. From a topmost portion or a distal or anterior position, the order of placement is said waveguide 62, said carrier 16, said bias circuit 40, and then said housing 12. In the preferred embodiment, said housing 12 is cylindrically shaped with an open top 17 and a substantially closed bottom or bottom wall 15 and an interior into which all of the aforesaid components fit and are housed with the exception of the waveguide 62. Said waveguide 62 preferably mates with said open top 17 and substantially covers said open top 17 with the exception of the acoustically active portion 22 of the diaphragm.

Said carrier 16 is preferably manufactured from an electrically insulating non-magnetic dielectric material having a substantially unity relative magnetic permeability which does not affect the magnetic fringing flux. Said carrier 16 holds the substantially planar diaphragm 20 and the electrical terminals 18 which electrically connect with a planar coil 24 on said diaphragm 20. Said diaphragm 20 is placed over a hole 33 in said carrier 16 which has a diameter or size approximately equal to the outside diameter 31 of the acoustically active portion 22 of the diaphragm 20. If desired, a protective screen 36 is placed and held between the carrier 16 and the waveguide 62 during assembly. In a preferred embodiment, the diaphragm 20 is placed on a top surface of said carrier 16, the thickness of said carrier 16 acting as the spacer or separator between the magnetic bias circuit 40 and the diaphragm 20. That is, maximal movement of said diaphragm 20 relative to the central magnetic disk 44 is limited to the space represented by the carrier 16 thickness. Alternative embodiments may utilize a plurality of spacing techniques between the diaphragm 20 and magnetic disk 44 including but not limited to layers or laminations, standoffs, or integral magnetic circuit projections.

In a preferred embodiment, the planar coil 24 comprises a conductive spiral 26 placed onto the acoustically active portion 22 of the diaphragm 20. The coil 24 preferably comprises a conductive aluminum material which is etched or deposited onto said diaphragm 20 beginning nearest the outer periphery of the acoustically active portion 22 and spiraling toward the center and substantially occupying the acoustically active portion 22. Other conductive materials may be utilized in alternative embodiments. Preferably, the electrical terminals 18 conductively connect with said coil 24 substantially central to said diaphragm and at or near the periphery of the acoustically active portion 22. The central connection is preferably via a non-magnetic small gauge wire extending from an electrical contact 18 on the carrier 16 to the central portion of the diaphragm 20. The connection at the periphery of the acoustically active portion 22 is preferably via extension of the etched or deposited conductive material toward an electrical contact 18 which is then connected via a non-magnetic small gauge wire extending from an electrical contact 18. In the preferred embodiment, the spiral 26 does not extend to the center or central portion 28 of the diaphragm 20 but substantially exists on the acoustically active portion 22 which is substantially exposed to atmosphere through an opening or feed port 63 of the waveguide 62.

Via the etching or depositing technique, the thickness of the conductive spiral 26 layer may be controlled which further controls the real resistance seen at the electrical terminals 18. Resistive control is of importance when utilizing amplifiers designed to drive approximately four to eight ohm real impedance loads. For the preferred embodiment, the real input resistance is approximately 3.5Ω to 4Ω.

Between a bottom side 21 of said diaphragm 20 and said magnetic bias circuit 40, preferably covering the central portion 28 of said diaphragm 20, is a first absorber disk 30, preferably of a felt or equivalent type material. This first disk 30 absorbs any acoustic emanations from the central portion 28 of the diaphragm 20 traveling rearward and further serves to hold the central portion 28 whereby any diaphragm 20 resonance modes must be of a higher order and thereby a higher non-audible frequency.

Between the top side 23 of said diaphragm 20 and a central phase plug 64 of said waveguide 62, also preferably covering the central portion 28 of said diaphragm 20, is a second absorber disk 32, preferably of a urethane or rubber like material. Preferably said second absorber disk 32 is attached via adhesive or other means to said diaphragm 20 and compresses collectively between said central phase plug 64, diaphragm 20, first absorber disk 30, and magnetic bias circuit 40 when assembled. The resultant sandwich assures a secure hold of the diaphragm 20 central portion 28 and minimizes fundamental diaphragm 20 resonances.

If a screen 36 is placed between the waveguide 62 and said diaphragm 20 as in the preferred embodiment, a third absorber disk 38, also of a urethane or rubber like material, is placed between said screen 36 and said second absorber disk 32. Also in a preferred embodiment, one or more peripheral absorbers 27 are placed between the carrier 16 top surface 19 and the waveguide 62 to ensure carrier 16 hold and limit carrier 16 vibration. The aforesaid disks 27, 30, 32, 38 may be manufactured from a plurality of compressible or non-compressible materials, have a plurality of layers or comprise multiple stacked disks, or have limited acoustic absorption properties.

In the preferred embodiment, a peripheral absorber ring 34 is placed substantially around said diaphragm 20 onto said carrier 16 top surface 19 and partially overlaps a peripheral diaphragm ring 25. Said peripheral absorber ring 34 is also of a urethane or rubber like material and serves to sandwich the carrier 16 and diaphragm 20 periphery between the waveguide 62 and the magnetic bias circuit 40. The peripheral diaphragm ring 25 is preferably of a hard polymer type material and serves to ensure a slight compressive sandwich between the diaphragm 20 periphery or outside diameter 31 of the acoustically active portion 22 and the waveguide 62. That is, the diaphragm 20 is held uniformly and securely onto the carrier 16 yet at the outside diameter 31 of the acoustically active portion 22 said peripheral diaphragm ring 25 is placed. The peripheral diaphragm ring 25 is approximately of equivalent size as the carrier 16 hole 33 and floats there within. In a preferred embodiment, the peripheral diaphragm ring 25 has an inside diameter 35 slightly smaller than the carrier 16 hole 33 diameter. The slightly smaller inside diameter 35 provides a uniform periphery for the acoustically active portion 22 and further allows the peripheral diaphragm ring 25 to reflect or attenuate diaphragm 20 acoustic energy transmitted toward or into the carrier 16. Again, the aforesaid rings 25, 34 may be manufactured from a plurality of materials including compressible or non-compressible materials having substantial or limited acoustic absorption properties or have a plurality of layers or comprise multiple stacked rings.

The magnetic bias circuit 40 seats within said housing 12 posterior to or near said bottom side 21 of said diaphragm 20 and imposes a high flux density magnetic field 42 upon said diaphragm 20, preferably substantially orthogonal to diaphragm 20 movement and spiral 26 current flow. Said magnetic bias circuit 40 comprises a high flux magnetic disk 44 positioned centrally and posterior to or near said bottom side 21 of said diaphragm 20, a substantially planar ring 48, a primary biasing magnet ring 46, a T-yoke 56, and a bucking magnet ring 54 which preferably seats with the bottom wall 15 of said housing 12.

Said magnetic disk 44 is preferably of a high flux density residual magnetic field material such as neodymium or a similar material. In a preferred embodiment, said disk 44 is substantially circular and planar and has a diameter 37 which is smaller than the outside diameter 31 and larger than the inside diameter 29 of the acoustically active portion 22 of the diaphragm 20. Since the periphery and center of the diaphragm 20 are substantially held, maximal diaphragm 20 induced force is desirable between these locations. Positioning a gap between said magnetic disk 44 and the surrounding planar ring 48 inside diameter 52 to create a resultant fringing or bending magnetic field substantially at the aforesaid diaphragm 20 portion ensures maximal efficiency and high fidelity reproduction. That is, positioning as aforesaid ensures a large fringing magnetic field where desired on the planar coil 24 spiral 26 conductor.

The substantially planar ring 48 has a thickness, an inside diameter 52, an outside diameter 50, and is preferably of a low carbon, low silicon steel material which has a saturation flux density (typically 1.9-2.0 Tesla) substantially above the magnetic flux density induced by the cumulative impinging magnetic field of the magnetic bias circuit 40. The aforesaid material exhibits a reasonably high relative permeability (typically $\mu_r$>5000) but by nature is less than a neodymium (typically $\mu_r>10^6$) or strontium ferrite (typically $\mu_r>8.5\times10^5$) material. The planar ring 48 serves to complete the magnetic circuit from the bucking magnet ring 54 through the low carbon, low silicon steel material of the housing 12 and further serves to complete the magnetic circuit from the primary biasing magnet ring 46. That is, since the outside diameter 50 of the planar ring 48 is substantially equivalent to the inside diameter 11 of the housing 12, a low reluctance magnetic path is created between the housing 12, bucking magnet 54, T-yoke 56, magnetic disk 44 and planar ring 48 with a high flux density fringing between the disk 44 and the planar ring 48. Although described as substantially planar for lexicographical purposes, said substantially planar ring 48 may take a plurality of shapes and forms including but limited to cross sections of triangular, rectangular, toroid, and hexagonal shape. Furthermore, if said substantially planar ring 48 is not utilized, the high flux density fringing will occur between the disk 44 and the primary biasing magnet ring 46.

In a preferred embodiment, sandwiched below the planar ring 48 and between the T-yoke 56 disk 58 is the primary biasing magnet ring 46 having residual magnetic properties and an inside diameter 39 and an outside diameter 41. Preferably the outside diameter 41 is equivalent to or less than the housing 12 inside diameter 11 and the inside diameter 39 is slightly greater than the planar ring 48 inside diameter 52 whereby the magnetic circuit flux is desirably directed onto the diaphragm 20 without creation of undesirable magnetic sub-circuits. In a preferred embodiment, the inside diameter 39 is of a greater size than a protrusion 60 of the T-yoke 56 and thereby forms a gap there between. The portion of the primary biasing magnet ring 46 nearest said diaphragm 20 has a magnetic pole (second magnetic pole) substantially opposite a magnetic pole (first magnetic pole) of the magnetic disk 44 nearest said diaphragm 20 whereby a high flux density fringing magnetic field is created onto the acoustically active portion 22 of the diaphragm 20.

In a preferred embodiment said primary biasing magnet ring 46 is of a strontium ferrite ($SrFe_{12}O_{19}$) magnet material which has a large residual magnetic field. Alternative embodiments may utilize barium or other types of ferrite or magnetic materials or not utilize said planar ring 48 and size the primary ring 46 to achieve a desired flux placement with said diaphragm 20. Although other types of magnetic materials may be utilized for the ring 46, ferrite materials have the advantage of high magnetic permeability, high residual magnetic field, and a high electrical resistance. The high electrical resistance minimizes the induced eddy current losses within the material which contributes to inefficiencies. The aforesaid material description also applies to the bucking magnet 54.

The T-yoke 56 comprises a disk 58 (or disk shape) having a central protrusion 60 of a preferably solid cylindrical shape and also of a preferably low carbon, low silicon ferromagnetic steel material which has a saturation flux density substantially above the magnetic flux density induced within. Said disk 58 is sandwiched or placed between the primary biasing magnet ring 46 and the bucking magnet ring 54 and directs magnetic flux therefrom through the central protrusion 60. (i.e. forms a portion of a low reluctance magnetic circuit) The disk 58 is purposely of a smaller diameter than the housing 12 inside diameter 11 in order to minimize leakage (i.e. form an undesired magnetic circuit) from the T-yoke 56 through the housing 12. The central protrusion 60 fits within the inside diameter of the ring 46 with a gap between the ring 46 and the protrusion 60 between which is placed a back energy acoustic absorber 61, preferably of a urethane foam material. That is, the primary biasing magnet ring 46 is positioned onto said T-yoke 56 with at least a portion of said protrusion 60 within said inside diameter 39 within said ring 46. Said high flux density magnetic disk 44 is positioned between said protrusion 60 and said diaphragm 20 and in a preferred embodiment adhesively attached to said protrusion 60. The gap there between 46, 60 assures that fringing magnetic flux is directed as described to the acoustically active portion 22 of the planar coil 24 diaphragm 20. Preferably, the protrusion 60 diameter and the disk 44 diameter 37 are approximately equal.

The bucking magnet 54 increases the magnetic flux impinging upon the spiral 26 and further serves to force the primary biasing magnet ring 46 flux through the magnetic circuit defined by the planar ring 48, T-yoke 56, and magnetic disk 44. In a preferred embodiment, said bucking magnet 54 also has residual magnetic properties and an inside diameter 43 substantially equivalent to the primary biasing magnet ring 46 inside diameter 39 and an outside diameter 45 slightly smaller than the primary biasing magnet ring 46 outside diameter 41. Said bucking magnet 54 substantially seats or is seated or positioned with the T-yoke 56 opposite said primary biasing magnet ring 46 with an opposite polarity. The bucking magnet 54 also substantially seats, is seated with, or positioned at the bottom wall 15 of the housing 12 in a preferred embodiment. The slightly smaller outside diameter 45 maximizes flux flow toward and through the central protrusion 60 of the T-yoke 56. The magnetic polarity of the bucking magnet 54 is purposely chosen to repel the pole of the primary magnet ring 46 closest to the bucking magnet 54 through the thickness of said disk 58. (i.e. a south pole of the bucking magnet 54 is closest to a south pole of the primary magnet ring 46 or visa-versa) That is, the fringing magnetic flux at the spiral 26 is the summation of the contributions not only of the magnetic disk 44 and the primary biasing magnet ring 46 but also the bucking magnet 54 with maximum primary biasing magnet 46 flux directed to the spiral 26.

During assembly, preferably the bucking magnet 54 is magnetized separately from the remaining magnetic circuit 40 components via immersion into a static magnetic field having a magnetic field strength commensurate with or greater than that necessary to induce a saturation flux density within the magnet 54 material. The combination of T-yoke 56, primary biasing magnet ring 46, planar ring 48, and high flux density magnetic disk 44 are assembled and then preferably immersed into a static magnetic field having a magnetic field strength sufficient or greater than that necessary to induce a saturation flux density within each of the aforesaid constituent component materials. The magnet rings 46, 54 and magnetic disk 44 are preferably magnetically polarized substantially perpendicular to the planar surfaces or substantially parallel with the ring or cylindrical axis. If anisotropic materials are utilized, maximal domain alignment must be within the aforesaid directions prior to magnetization. In the preferred embodiment, all of the aforesaid components including the bucking magnet 54 are adhesively bound together, preferably with an anaerobic adhesive, at the respective interfaces.

The aforesaid acoustic horn waveguide 62 uniquely interfaces with the assembled acoustic components and maximizes the acoustic power and fidelity output. The waveguide 62 comprises a feed port 63 which, in a preferred embodiment, is sized to substantially match and seat over the acoustically active portion 22 of the diaphragm 20. Substantially central to said feed port 63 is the central phase plug 64 having a substantially conical ogive form which is held by one or more arms 66 (preferably three) extending from the inverted conical portion 68 of the waveguide 62 peripheral to the feed port 63.

As understood within the acoustic arts, the acoustic impedance of a material is proportional to the material density (ρ) multiplied by the acoustic velocity (c) or the square root of the density (ρ) divided by the modulus of elasticity (λ, Young's modulus) within the material.

$$Z_o \propto \rho \cdot c \propto \sqrt{\frac{\rho}{\lambda}}$$

Since the diaphragm 20 with the associated spiral 26 conductor is of slightly greater density and has a slightly greater acoustic velocity than atmosphere, the acoustic impedance is inherently mismatched to the acoustic impedance of atmospheric free space. The waveguide 62 with the distally pointed (relative to the diaphragm 20) conical ogive phase plug 64 and the inverted conical portion 68 provide a tapered acoustic transformer between the acoustic generator and atmosphere which maximizes transmission there between. That is, the waveguide 62 partially or substantially matches the acoustic impedance of the diaphragm 20 to the atmosphere. Preferably, each of said arms 66 are tapered to an edge distally from said diaphragm 20 to further ensure a smooth tapered acoustic match.

The phase plug 64 further ensures a uniform phase field external to the loudspeaker 10. That is, the acoustic emanation from a first side of the diaphragm 20 cannot transmit and mix with the emanation from a second side of the diaphragm 20. The phase plug 64 isolates each emanating portion and prevents an atmospheric or free space mixing and phase distortion of the audio signal.

In the preferred embodiment, a recess 72 is provided in a backside 70 of the waveguide 62 which substantially matches the outline of the carrier 16 which is sandwiched between the waveguide 62 and the magnetic bias circuit 40. This recess 72 preferably extends peripherally to the waveguide 62 whereby the carrier 16 may exit between the waveguide 62 and housing 12 and expose the electrical terminals 18 for attachment of an amplifier drive.

Figure 15:
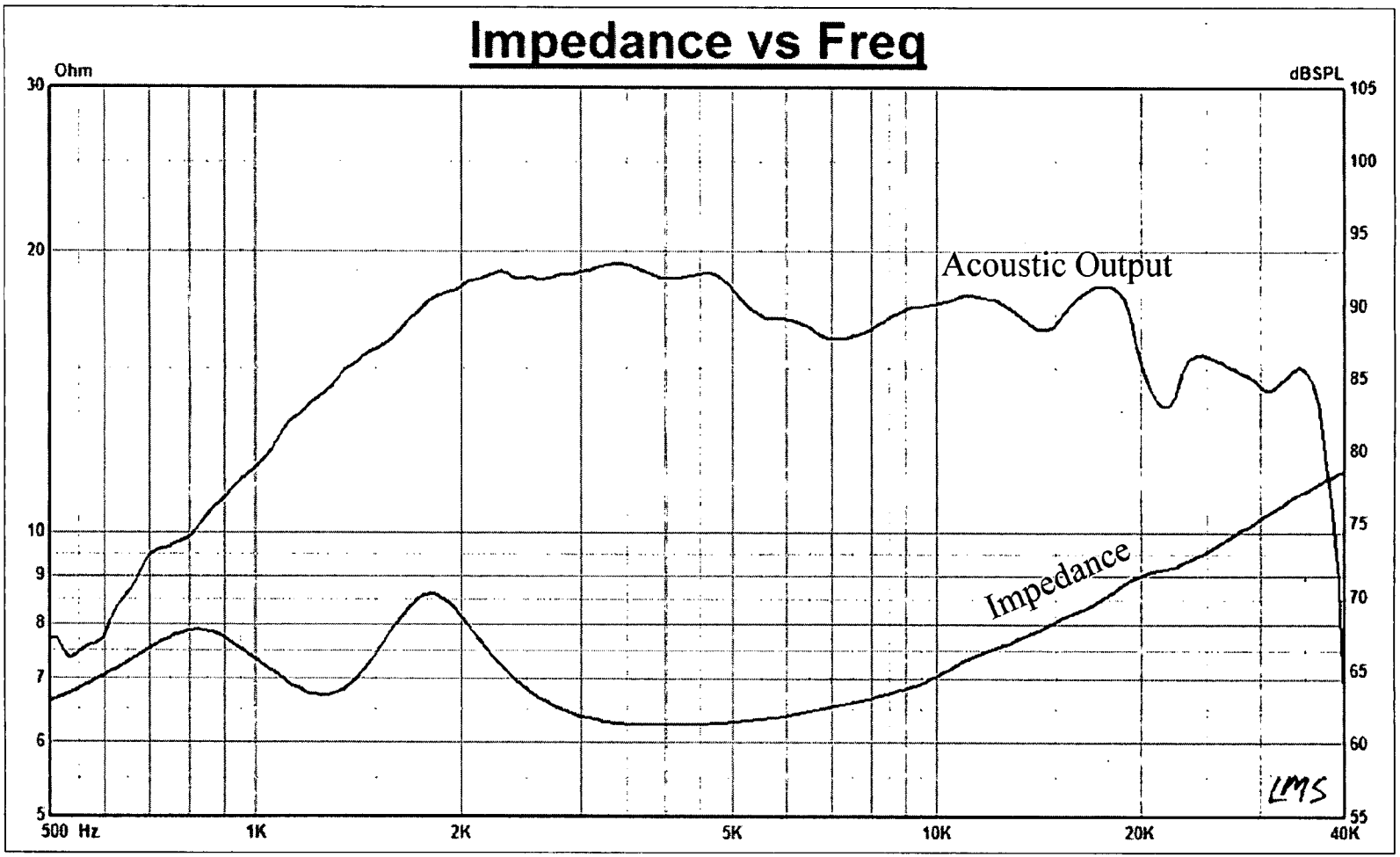
Fig. 15 Prior Art
FIG. 15 shows a plot of impedance input in ohms and an acoustic output level in dB (sound pressure level) versus frequency of a prior art loudspeaker tweeter as previously discussed.
Figure 16:
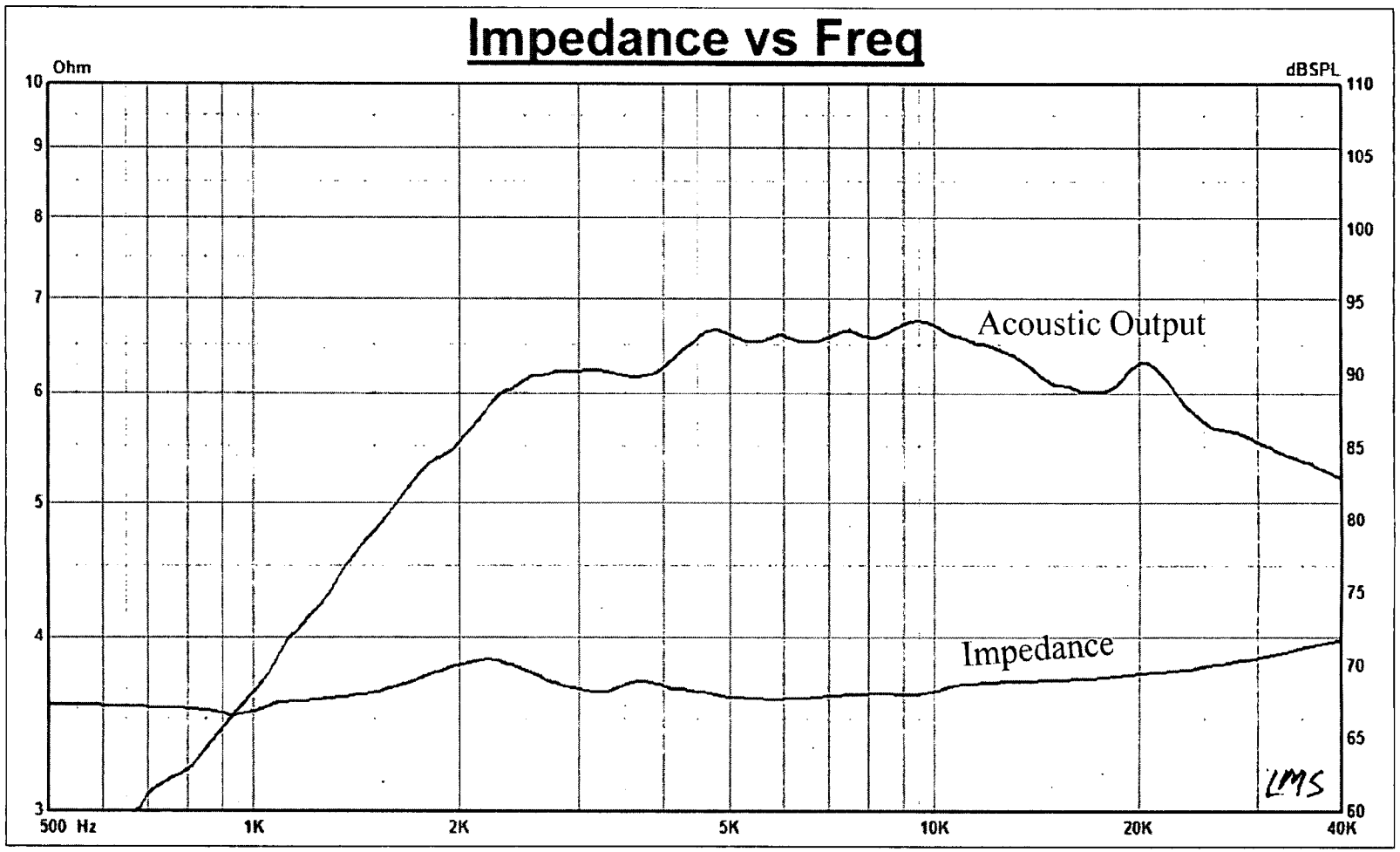
FIG. 16 shows a plot of impedance input in ohms and acoustic output level in dB (sound pressure level) versus frequency of a present art loudspeaker tweeter.
Figure 17:
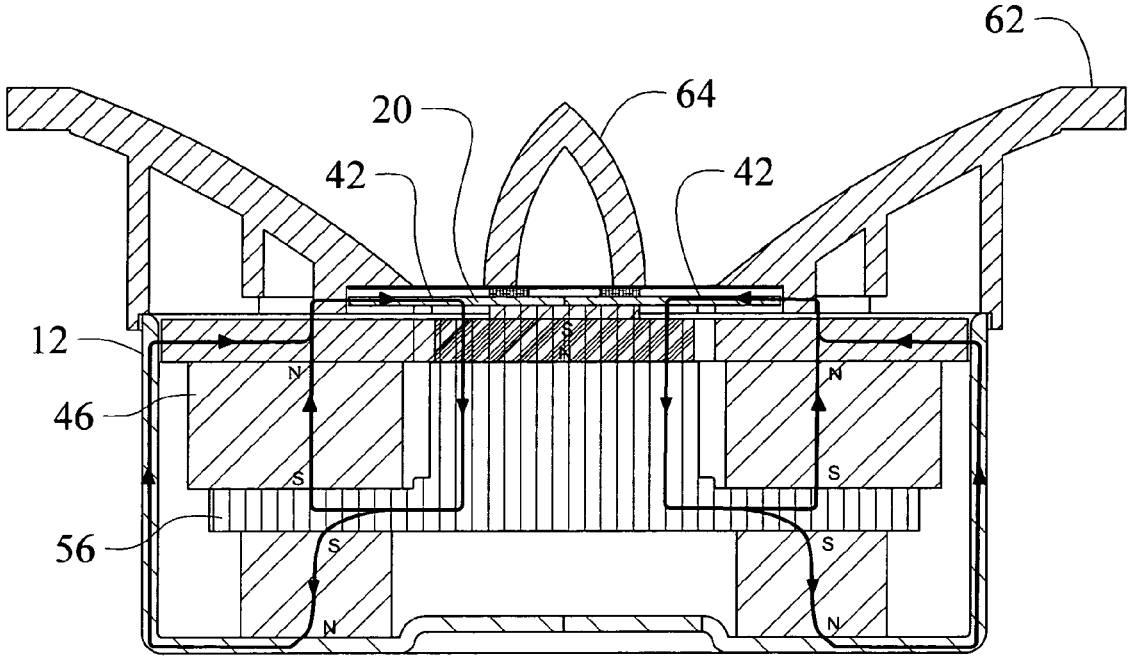
FIG. 17 shows the magnetic circuit and bulk magnetic flux flow for the present art when viewed in an equivalent cross section as seen in FIG. 5.

The benefits of the present art 10 are best understood when the prior art input impedance and acoustic power level output of the prior art (FIG. 15) are analyzed relative to the equivalent plot for the present art 10 as seen in FIG. 16. It is important to note that both FIGS. 15 & 16 are small diameter tweeter loudspeakers which have diaphragms of approximately 25 millimeters and are driven by a constant potential value (i.e. voltage value) alternating current. The impedance ordinate of the prior art FIG. 15 is logarithmic from five to 30 ohms while that of the present art FIG. 16 is logarithmic from three to only 10 ohms. The acoustic power ordinate is linear due to the unit delineation as dB sound pressure level (dB SPL) which is inherently logarithmic.

FIG. 15, shows a substantial peak and trough of acoustic output power versus frequency below and above 20 kilohertz (kHz) with a differential of approximately eight dB. This fluctuation is attributed to diaphragm resonance. The FIG. 15 impedance plot shows a substantially increasing input impedance versus frequency above 10 kHz which is attributable to leakage inductance. Between 10 kHz and 40 kHz the variation is approximately 5Ω. Both of these prior art characteristics are undesirable for high fidelity acoustic reproduction.

The present art 10 as represented in FIG. 16 shows a slight acoustic power output peak near 20 kHz of about three dB. This peak can also be attributed to a slight diaphragm resonance but is substantially less than the eight dB prior art and at the edge or outside of audible range. Remarkably, the present art 10 impedance plot is substantially flat. Between 10 kHz and 40 kHz, the input impedance varies by less than 0.4Ω. As expected, this 0.4Ω increase can be attributed to a slight leakage inductance but is greater than an order of magnitude less than the prior art. Furthermore, the acoustic power output versus frequency for the present art 10 is substantially "flatter" than the prior art. Although an impedance and acoustic power output deviation of zero are desirable, the laws of mechanical dynamics and electromagnetics prohibit such for a passive device without active compensation.

From the foregoing description, those skilled in the art will appreciate that all objects of the present invention are realized. A planar diaphragm acoustic loudspeaker 10 is shown and described. The present art 10 is especially suited for substantially flat and efficient acoustic reproduction without the undesirable prior art mass and diaphragm resonance distortions. The present art 10 uniquely provides a high flux density magnetic bias to a planar diaphragm 20 which is optimally coupled to atmosphere through a waveguide 62 without the introduction of a phase distortion.

Having described the invention in detail, those skilled in the art will appreciate that modifications may be made to the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A planar diaphragm acoustic loudspeaker comprising: a housing, an acoustic waveguide, a planar diaphragm having a planar electrically conductive coil, and a high flux density magnetic bias circuit; and said planar diaphragm and said magnetic bias circuit positioned between said housing and said acoustic waveguide and said planar diaphragm capable of acoustically feeding through a feed port of said acoustic waveguide; and said planar diaphragm having a bottom side, a top side nearest said acoustic waveguide, and an acoustically active portion having an inside diameter and an outside diameter; and said magnetic bias circuit first comprising a high flux density residual magnetic field magnetic disk having a diameter smaller than the outside diameter and larger than the inside diameter of said acoustically active portion and positioned near said bottom side of said diaphragm; and said magnetic bias circuit also comprising a T-yoke having a central protrusion nearest said diaphragm and said T-yoke substantially of a ferromagnetic material having a saturation flux density greater than a magnetic flux density induced by said magnetic bias circuit; and said high flux density magnetic disk positioned between said protrusion and said diaphragm; and said magnetic bias circuit further comprising a primary biasing magnet ring having a residual magnetic field and having an inside diameter and an outside diameter and positioned substantially onto said T-yoke with at least a portion of said protrusion within said inside diameter; and said magnetic disk having a first magnetic pole nearest said diaphragm which is substantially opposite a second magnetic pole of said primary biasing magnet ring nearest said diaphragm; and said magnetic bias circuit formed through said magnetic disk, said T-yoke, and said primary biasing magnet ring and a high flux density fringing field between said magnetic disk and said primary biasing magnet ring; and said fringing field at least partially positioned onto said acoustically active portion of said diaphragm whereby an alternating current in said planar coil moves said diaphragm due to said fringing field and emanates acoustic energy through said feed port of said waveguide.

2. The planar diaphragm acoustic loudspeaker as set forth in claim 1 whereby said magnetic disk comprises:

a high residual flux density neodymium-iron-boron alloy material.

3. The planar diaphragm acoustic loudspeaker as set forth in claim 1 further comprising: a substantially planar ring having an outside diameter and an inside diameter and positioned between said primary biasing magnet ring and said diaphragm; and said substantially planar ring also of a ferromagnetic material having a saturation flux density greater than a magnetic flux density induced by said magnetic bias circuit; and said inside diameter of said substantially planar ring is sufficiently large to fit over at least a portion of said magnetic disk or said protrusion of said T-yoke and having a gap there between and further directing said high flux density fringing field between said substantially planar ring and said magnetic disk.

4. The planar diaphragm acoustic loudspeaker as set forth in claim 1 further comprising: a bucking magnet ring having a residual magnetic field and having an inside diameter and an outside diameter and positioned between said T-yoke and a bottom wall of said housing; and said bucking magnet ring having a magnetic polarity which repels a pole of said primary magnet ring closest to said bucking magnet ring through a thickness of a disk of said T-yoke; and said housing formed from a ferromagnetic material also having a saturation flux density greater than a magnetic flux density induced by said magnetic bias circuit; and said bucking magnet further directing a flux of said primary biasing magnet through said T-yoke protrusion and providing a further flux through a path of said housing and said T-yoke and increasing said high flux density fringing field.

5. The planar diaphragm acoustic loudspeaker as set forth in claim 3 further comprising: a bucking magnet ring having a residual magnetic field and having an inside diameter and an outside diameter and positioned between said T-yoke and a bottom wall of said housing; and said bucking magnet ring having a magnetic polarity which repels a pole of said primary magnet ring closest to said bucking magnet ring through a thickness of a disk of said T-yoke; and said housing formed from a ferromagnetic material also having a saturation flux density greater than a magnetic flux density induced by said magnetic bias circuit; and said bucking magnet further directing a flux of said primary biasing magnet through said T-yoke protrusion and providing a further flux through a path of said housing and said T-yoke and said substantially planar ring and increasing said high flux density fringing field.

6. The planar diaphragm acoustic loudspeaker as set forth in claim 1 whereby said planar diaphragm further comprises:

a spiral on said diaphragm substantially within said acoustically active portion and forming said planar coil; and a first absorber disk substantially at a central portion of said diaphragm and between said bottom side of said diaphragm and said magnetic disk; and a second absorber disk substantially at said central portion of said diaphragm between said top side and said waveguide whereby said central portion is substantially held by said disks.

7. The planar diaphragm acoustic loudspeaker as set forth in claim 6 further comprising:

a carrier placed between said magnetic bias circuit and said waveguide and having a top surface and a hole over which said diaphragm is held and placed; and a peripheral absorber ring substantially surrounding said hole on said top surface of said carrier and sandwiched between said waveguide and said carrier.

8. The planar diaphragm acoustic loudspeaker as set forth in claim 7 further comprising:

said diaphragm placed on said top surface of said carrier; and a peripheral diaphragm ring between said peripheral absorber ring and said diaphragm and having an inside diameter slightly smaller than a diameter of said hole.

9. The planar diaphragm acoustic loudspeaker as set forth in claim 8 further comprising:

a screen between said diaphragm and said waveguide; and a third absorber disk between said screen and said second absorber disk.

10. The planar diaphragm acoustic loudspeaker as set forth in claim 1, said acoustic waveguide further comprising:

a phase plug having a conical ogive form and held substantially central to said feed port; and said waveguide having an inverted conical shape peripheral to said phase plug; and one or more arms between said conical shape and said phase plug whereby said waveguide ensures a substantially uniform phase field and at least partially matches an acoustic impedance of said diaphragm with an atmospheric impedance.

11. The planar diaphragm acoustic loudspeaker as set forth in claim 4, said acoustic waveguide further comprising:

a phase plug having a conical ogive form and held substantially central to said feed port; and said waveguide having an inverted conical shape peripheral to said phase plug; and one or more arms between said conical shape and said phase plug whereby said waveguide ensures a substantially uniform phase field and at least partially matches an acoustic impedance of said diaphragm with an atmospheric impedance.

12. The planar diaphragm acoustic loudspeaker as set forth in claim 5, said acoustic waveguide further comprising:

a phase plug having a conical ogive form and held substantially central to said feed port; and said waveguide having an inverted conical shape peripheral to said phase plug; and one or more arms between said conical shape and said phase plug whereby said waveguide ensures a substantially uniform phase field and at least partially matches an acoustic impedance of said diaphragm with an atmospheric impedance.

13. A planar diaphragm acoustic loudspeaker comprising: a high remnant flux density magnetic disk of a neodymium magnetic material having a diameter, a first magnetic polarity, and placed upon a central protrusion of a T-yoke; and a primary biasing magnet ring of a strontium ferrite material having a remnant flux density and placed surrounding said protrusion with a gap there between and having a second magnetic polarity substantially opposite said magnetic disk magnetic polarity; and a substantially planar ring placed upon said primary biasing magnet ring and at least partially surrounding said magnetic disk with a gap there between; and said planar ring and said T-yoke having a saturation magnetic flux density greater than a flux density imposed by said magnetic disk and said primary biasing magnet ring; and a planar diaphragm having a planar electrically conductive coil and an acoustically active portion, at least a portion of said acoustically active portion placed over said magnetic disk; and an acoustic waveguide having a feed port and a phase plug placed over said planar diaphragm opposite said magnetic disk whereby an alternating current within said planar coil moves said diaphragm under the influence of a high flux density magnetic field imposed by said magnetic disk and said primary biasing magnet ring and said waveguide at least partially acoustically matches said diaphragm with the atmosphere and further provides a substantially uniform phase field.

14. The planar diaphragm acoustic loudspeaker as set forth in claim 13 further comprising:

a bucking magnet having a remnant flux density and substantially seated with said T-yoke opposite said primary biasing magnet ring with a magnetic polarity substantially opposite said primary biasing magnet ring; and a housing of a ferromagnetic material substantially seated with said bucking magnet opposite said T-yoke and completing a magnetic circuit including said bucking magnet, T-yoke, magnetic disk, and planar ring.

15. The planar diaphragm acoustic loudspeaker as set forth in claim 13 further comprising:

a carrier between said waveguide and said magnetic disk holding said planar diaphragm; and a hole in said carrier exposing at least a portion of said acoustically active portion to said feed port or said magnetic disk; and a first absorber disk substantially centrally positioned onto said acoustically active portion between said diaphragm and said magnetic disk; and a second absorber disk substantially centrally positioned onto said acoustically active portion between said diaphragm and said waveguide whereby said disks substantially limit central movement of said diaphragm and thereby limit audible diaphragm resonances.

16. The planar diaphragm acoustic loudspeaker as set forth in claim 14 further comprising:

a carrier between said waveguide and said magnetic disk holding said planar diaphragm; and a hole in said carrier exposing at least a portion of said acoustically active portion to said feed port or said magnetic disk; and a first absorber disk substantially centrally positioned onto said acoustically active portion between said diaphragm and said magnetic disk; and a second absorber disk substantially centrally positioned onto said acoustically active portion between said diaphragm and said waveguide whereby said disks substantially limit central movement of said diaphragm and thereby limit audible diaphragm resonances.

17. The planar diaphragm acoustic loudspeaker as set forth in claim 15 further comprising: a peripheral absorber ring substantially surrounding said acoustically active portion of said diaphragm.

18. The planar diaphragm acoustic loudspeaker as set forth in claim 16 further comprising: a peripheral absorber ring substantially surrounding said acoustically active portion of said diaphragm.

19. The planar diaphragm acoustic loudspeaker as set forth in claim 15 further comprising:

a peripheral diaphragm ring substantially positioned peripheral to said acoustically active portion.

20. The planar diaphragm acoustic loudspeaker as set forth in claim 16 further comprising:

a peripheral diaphragm ring substantially positioned peripheral to said acoustically active portion.

* * * * *